United States Patent [19]

Chester

[11] 4,257,924

[45] Mar. 24, 1981

[54] ANTI-STATIC COMPOSITION COMPRISING A CATIONIC SURFACTANT, RUE OIL AND PROPYLENE GLYCOL

[75] Inventor: Richard M. Chester, Syracuse, N.Y.

[73] Assignee: Bect Chemical Co., Syracuse, N.Y.

[21] Appl. No.: 967,079

[22] Filed: Dec. 6, 1978

[51] Int. Cl.[3] ..... C11D 1/62; C11D 1/38; D06M 13/46

[52] U.S. Cl. ..... 252/547; 8/137; 252/8.8; 252/88

[58] Field of Search ..... 252/8.8, 547, 528, 117, 252/88; 8/137

[56] References Cited

U.S. PATENT DOCUMENTS 4,134,838 1/1979 Hooper et al. ..... 252/8.8

*Primary Examiner*—Harris A. Pitlick

*Attorney, Agent, or Firm*—Charles S. McGuire

[57] ABSTRACT

An anti-static compound comprising a complex thermoset combination of a cationic surfactant containing from 8 to 22 carbon atoms, an essential oil and a glycol. Heating a mixture of the cationic surfactant, essential oil and glycol results in a composition wherein the oil bonds directly to the cationic compound with a resinous effect, surrounding the cationic charged particles, thereby prolonging discharge capability. The composition may be applied directly to the surface of materials to be anti-statically treated, or combined with detergents or shampoos to impart the treatment during normal washing, or included in certain polymers during manufacture of the synthetic fibers prior to extrusion. The composition of the invention acts as an anti-static agent possessing increased effectiveness, stability and longevity.

9 Claims, No Drawings

ANTI-STATIC COMPOSITION COMPRISING A CATIONIC SURFACTANT, RUE OIL AND PROPYLENE GLYCOL

BACKGROUND OF THE INVENTION

The present invention relates to anti-static compositions and treatments, and more specifically to a new composition having improved properties as an anti-static agent.

The marked tendency of thermoplastic polymers and other materials to accumulate static charges have prompted study of possible means of eliminating or reducing this property, which may be undesirable for a variety of reasons. For example, dust and other particles for foreign matter adhere more readily to fibers such as those used in making carpeting and clothing materials which carry a static charge. Static discharge or sparks from articles carrying a static charge can be hazardous in explosive atmospheres. Static charges on human hair promote more rapid soiling and other cosmetically undesirable effects. Objectionable features of accumulated static charges are also well known in other circumstances.

Among the attempted approaches to allieviating this problem are the following:

1. Development of more electrically conductive polymers, e.g., tetracyanoquinodimethane.

2. Incorporation of additives which migrate to the surface of the plastic or fiber and modify its electrical properties, examples of these being fatty quaternary ammonium compounds, fatty amines, and phosphate esters; other types of anti-static additives are hygroscopic compounds, such as polyethylene glycols, and hydrophobic slip additives which markedly reduce the coefficient of friction of the plastic.

3. Copolymerization of an anti-static resin with the base polymer.

While all of the foregoing approaches to providing a satisfactory anti-static treatment have met with certain degrees of success, all are limited in some manner in effectiveness and/or inconvenient methods of application. For example, static charges may be prevented from building up on clothing during the drying process by placing specially treated cloths, or the like, in the dryer or by adding chemical solutions to the wash or rinse water; however, no chemical is known to applicant which may be combined with the detergent prior to packaging which will serve to treat the clothing against static buildup as well or better than prior art treatments. Essentially the same is true of carpets; that is, special anti-static sprays, or the like, are available for application after washing and drying, but no anti-static agent is known which may be combined directly with the rug shampoo and will continue in its effectiveness after drying and repeated vacuuming.

OBJECTS OF THE INVENTION

It is a principal object of the invention to provide novel compounds and methods of preparation thereof which have improved effectiveness, longevity and/or stability as anti-static agents when applied to other materials.

A further object is to provide novel and improved anti-static agents which are compatible and may be combined with commercially available detergents, shampoos, and the like, over a wide range of concentrations and which will impart anti-static properties to materials washed with such detergents and shampoos.

Another object is to provide a novel and improved composition which may be incorporated in a polymer during manufacture thereof and which imparts anti-static qualities to subsequently extruded fibers made therefrom.

Other objects will in part be obvious and will in part appear hereinafter.

SUMMARY OF THE INVENTION

The foregoing objects are achieved according to the invention by a composition comprising a cationic surfactant having from 8 to 22 carbon atoms, an aldehyde oil and a glycol. The oil and glycol are mixed in the presence of heat and the cationic surfactant is then added. The oil bonds directly to the cationic compound to effectively surround the cationically charged particles to prolong discharge capability. The composition has been found to be compatible with commercially available detergents and shampoos to impart anti-static qualities to materials washed therewith. Also, when the composition is added to polymers from which synthetic fibers are to be formed for subsequent use in the manufacture of carpets, etc., upon extrusion of the fibers in the normal manner, the anti-static composition will bloom to the surface, imparting long-lasting anti-static properties to the fibers.

DETAILED DESCRIPTION

As previously stated, the invention is directed to a composition including a cationic surfactant having from 8 to 22 carbon atoms, an aldehyde oil such as an essential oil and a glycol. The preferred cationic surfactant used is a quaternary ammonium compound. The quaternary ammonium compound found most acceptable is dialkyl dimethyl ammonium chloride expressed by the following formula:

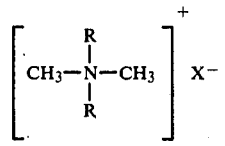

wherein R is a saturated or unsaturated aliphatic group having 8 to 22 carbon atoms, and X is chloride or methyl sulphate.

The dialkyl dimethyl ammonium chloride is supplied at typical 74% active concentration in aqueous isopropanol. It is a light colored liquid at room temperature and dispersions of almost any concentration may be made using cool water. Laboratory tests on dialkyl dimethyl ammonium chloride show that the compound is nonirritating to the skin and eyes, which is of significant importance when used as an anti-static compound.

As the aldehyde oil, there is preferably mentioned an essential oil. The essential oil found most compatible with the quaternary ammonium compound is rue oil, distilled from the blossoming plants of various species of the genus Ruta. The chief constituents of rue oil are methyl n-nonyl ketone, methyl n-heptyl ketone and methyl anthranilate. Although the invention is not bound by any theory it is believed that the rue oil has provided the solution of the prior art problems in the field of anti-static composition of extended longevity. This is because of direct bonding of the rue oil to the methyl ring of the cationic surfactant. Other keto ester aldehydes can also be used.

Propylene glycol is an excellent solvent of oils, which makes it a good glycol to mix with an essential oil. Propylene glycol having the formula $CH_3CHOHCH_2OH$ of refined technical grade is a colorless, viscous hygroscopic liquid that is miscible with alchols and other organic solvents.

The anti-static composition is prepared by dissolving about 0.1% by weight of rue oil in about 1.0% by weight of propylene glycol and heating on a water bath to about 100° F. About 98.9% dialkyl dimenthyl ammonium chloride is heated until warm and added to the rue oil and propylene glycol mixture. The rue oil and propylene glycol mixture are agitated as the dialkyl dimethyl ammonium chloride is added. When the mixture is uniform, that is clear in color, the temperature is raised to about 140° to 149° F. for about 10 minutes. The pH is adjusted to 7.0–7.5. The resulting composition is an anti-static compound of dialkyl dimethyl ammonium chloride with an essential oil of rue oil bonded directly to a methyl ring of the cationic surfactant compound.

The anti-static composition was tested for longevity by applying a 0.4% solution using an atomization spray to a styrene jar and air dried. An untreated control sample was also prepared for the test. Both samples were scanned with a static electricity meter; the control sample reading was 300–500 volts and the coated sample zero. The samples were tested after one week, three weeks, six weeks and nine weeks by rubbing the coated sample and the control sample with a nylon cloth. The results of this test were as follows:

| | 1 wk. | 3 wks. | 6 wks. | 9 wks. |
|---|---|---|---|---|
| coated sample | 0 | 0 | 0 | 0 |
| control sample | 3500 volts | 5500 volts | 4000 volts | 4300 volts |

The results of the test show that the longevity of the anti-static composition is superior to the untreated control sample.

Anti-static tests conducted on the anti-static composition were divided into three parts:

1. a study of the compatibility of the anti-static composition with carpet cleaning detergents;
2. a study of the anti-static properties with detergents;
3. a study of the resoiling characteristics of the carpet after washing with detergents with and without the anti-static composition.

The compatibility tests consisted of adding various amounts of the anti-static composition in the concentrated form to one gallon of Blue Lustre TM carpet shampoo at about one part Blue Lustre TM and seven parts water, and to one gallon of RinseNVac TM carpet detergent solution, one gallon water to two ounces of RinseNVac TM detergent. If no phase separation occurred, the mixtures were rated compatible.

The results of these tests showed that the anti-static composition of the invention is compatible with both the concentrated and diluted Blue Lustre TM and the RinseNVac TM detergent solutions. Anti-static properties of the detergent solutions with the anti-static composition were determined by adding one oz. of the anti-static composition solution (1 oz. anti-static composition to 3 oz. water) to one gallon of detergent solution at use dilution. The Blue Lustre TM mixture was applied to 2×3 ft. sections of plush pile nylon carpet and allowed to dry 24 hours; then, the carpet sections were vacuumed. The anti-static composition and RinseNVac TM detergent mixture was applied to the carpet sections and allowed to dry for 24 hours. The carpet sections were then ready for static electrical charge test.

The static electrical charge test consists of rubbing a glass rod across the carpet section to be tested. The charged rod is then brought near the probe of an electrometer. The lower the reading, the better the anti-static properties of the carpet. An untreated carpet specimen will give off full-scale readings of three, while a treated specimen will be less than one. The results of these tests are presented in the following table. Static values above about 2.6 will give a static shock to a person walking on the carpet.

STATIC CHARGE SUPPRESANT BY ANTI-STATIC COMPOSITION IN CARPET CLEANING

| Static Charge[a] | | | | |
|---|---|---|---|---|
| Blue Lustre[b] No. 1 | Blue Lustre[b] No. 2 | RinseNVac[c] No. 1 | RinseNVac[c] No. 2 | Standard[d] No Treatment |
| 0.08 | 0.10 | 0.00 | 0.05 | 3.0 |
| 0.09 | 0.10 | 0.00 | 0.05 | 3.0 |
| 0.12 | 0.12 | 0.01 | 0.08 | 3.0 |
| 0.80 | 0.90 | 0.80 | 0.80 | 3.0+ |
| 0.90 | 1.00 | 1.00 | 1.20 | 3.0+ |
| 1.10 | 1.20 | 1.10 | 1.20 | 3.0+ |
| 0.80 | 1.00 | 1.10 | 1.30 | 3.0+ |
| 1.00 | 1.20 | 1.80 | 2.20 | 3.0+ |
| 1.00 | 1.20 | 1.80 | 2.20 | 3.0+ |
| 1.30 | 1.50 | 1.80 | 2.30 | 3.0+ |
| 1.30 | 1.40 | 1.90 | 2.40 | 3.0+ |
| — | 1.50 | — | 2.30 | 3.0+ |
| 0.80[e] | 1.30 | 2.10[e] | 2.30 | 3.0+ |
| 0.80 | 1.40 | 2.08 | 2.30 | 3.0+ |
| 0.90 | 1.40 | 2.10 | 2.40 | 3.0+ |
| 1.20 | 1.50 | 2.16 | 2.30 | 3.0+ |

[a]The higher the reading the greater the static electrical charge. A reading of three is full-scale. A reading of 1.8 is the maximum that will provide anti-static protection.
[b]Blue Lustre TM Nos. 1 and 2 are duplicate treatments with the same cleaning solution applied to the carpet test specimen and allowed to dry for 24 hr. at ambient conditions (77° F. and 50% RH). The treating solution was 1 oz. anti-static composition at use dilution (1 oz. anti-static compostition plus 3 oz. water), plus 1 gal. Blue Lustre TM at use dilution (16 oz. Blue Lustre TM plus 112 oz. water).
[c]RinseNVac TM Nos. 1 and 2 were duplicate treatments with the same cleaning solution applied to the carpet test specimen and allowed to dry 24 hrs. at ambient conditions (77° F. and 50% RH). The treating solution was 1 oz. anti-static composition at use dilution (1 oz. anti-static composition plus 3 oz. water) plus 1 gal. RinseNVac TM at use dilution (2 oz. RinseNVac TM) plus 128 oz. water).
[d]Standard: A new sample of uncleaned carpet.
[e]Reading 24 hr after soiling and vacuuming.

To determine the effect of the anti-static composition on resoiling, 2×3 ft. sections of a plush pile nylon carpet were cleaned with Blue Lustre TM and RinseNVac TM detergents at use dilutions with and without the anti-static composition. After cleaning and drying for 48 hours, the carpet sections were soiled with vacuum cleaner soil, then cleaned with a vacuum cleaner to determine the effect, if any, of the anti-static composition on soil pickup and retention.

In conducting the cleaning tests, the only deviation from the manufacturer's recommendation was that a scrub brush was used to apply the Blue Lustre TM to the carpet specimens instead of a carpet shampoo machine. The results of the cleaning tests showed that both the treated carpet and untreated carpet exhibited the same degree of soil removal when vacuumed. It is concluded that carpets cleaned with the Blue Lustre TM cleaner and RinseNVac TM detergents with the anti-static composition do not resoil and retain more soil than carpets cleaned with the detergents by themselves.

In addition to applying the anti-static composition with carpet detergents, the anti-static composition can be incorporated in a synthetic fiber polymer at the time of manufacture; that is, it can be encapsulated in the polymer bead and when the fiber is extruded, molecular migration of the anti-static composition to the surface of the fiber occurs. This provides a fiber polymer with less tendency to accumulate static charge.

The anti-static composition is a highly hydrophilic glycolized quaternary ammonium compound. As a glycolized quat it reduces the corrosivity commonly associated with chloride quaternary counterparts.

The new anti-static composition is suitable for use with most resins, or other compounds, which exhibit static electricity problems. Polyester clothing, curtains and drapes, are among the items that can be treated with the anti-static composition. It comes in liquid form for spraying, dipping or mixing. Among its other advantages it has an extended shelf life, it is safe to handle without special precautions, it has a pleasant aroma, and it retains its effectiveness.

What is claimed is:

1. An antistatic composition having prolonged discharge capabilities comprising:

a cationic surfactant, rue oil, and propylene glycol, where the rue oil is about 0.1 percent of the composition and the propylene glycol is about 1.0 percent.

2. An antistatic composition according to claim 1 wherein said cationic surfactant is quaternary ammonium compound.

3. An antistatic composition according to claim 2 wherein said quaternary ammonium compound is dialkyl dimethyl ammonium chloride.

4. The method of preparing an antistatic composition comprising:

(a) dissolving about 0.1% by weight of rue oil in about 1.0% by weight of propylene glycol at a temperature of about 100° F.;

(b) adding to the rue oil-propylene glycol solution about 98.9% by weight of a cationic surfactant;

(c) heating the resulting mixture until clear; and (d) raising the temperature to about 140° to 149° F. for about 10 minutes to thermoset the composition.

5. The method of claim 4 wherein said cationic surfactant is a quaternary ammonium compound.

6. The method of claim 5 wherein said quaternary ammonium compound is dialkyl dimethyl ammonium chloride.

7. The method of claim 4, 5 or 6 including the further step of adjusting the pH to between about 7.0 and 7.5.

8. A method of treating carpets, comprising:

(a) preparing a composition comprising a cationic surfactant, about 0.1 percent by weight of rue oil and about 1.0 percent by weight of propylene glycol;

(b) mixing a predetermined quantity of said composition with a conventional carpet cleaning solution; and (c) washing the carpet with said mixture to effect simultaneous cleaning and imparting of anti-static properties thereto.

9. The method of claim 8 wherein said cationic surfactant is a quaternary ammonium compound.

* * * * *